US005809608A

United States Patent [19]

Zadro

[11] Patent Number: 5,809,608

[45] Date of Patent: Sep. 22, 1998

[54] ADJUSTABLE LENGTH SQUEEGEE

[76] Inventor: Zlatko Zadro, 5332 System Dr., Huntington Beach, Calif. 92649

[21] Appl. No.: 533,463

[22] Filed: Sep. 25, 1995

Related U.S. Application Data

[63] Continuation-in-part of Ser. No. 386,449, Feb. 10, 1995, abandoned.

[51] Int. Cl.[6] ..... B41F 15/44

[52] U.S. Cl. ..... 15/245; 15/250.39; 15/245.1; D32/41

[58] Field of Search ..... 15/245, 245.1, 15/250.39, 250.41, 105, 117, 121, 118, 220.1, 220.2, 244.1, 236.02, 236.05, 250.48, 143.1, 236.06, 144.1; D32/41, 42; 248/691, 692, 685; 101/114

[56] References Cited

U.S. PATENT DOCUMENTS

| | | | |
|---|---|---|---|
| 421,683 | 2/1890 | Draper | 248/685 |
| 629,851 | 8/1899 | Glen | 15/245 |
| 909,793 | 1/1909 | Hening | 15/121 |
| 1,117,895 | 11/1914 | Osaka | 15/245 |
| 1,328,162 | 1/1920 | Hecht | 248/691 |
| 1,838,158 | 12/1931 | Schwartz | 15/245 |
| 1,989,296 | 1/1935 | Smulski | 15/250.41 |
| 2,580,814 | 1/1952 | Morley | 15/245 |
| 3,950,813 | 4/1976 | Buck | 15/245 |
| 4,339,838 | 7/1982 | Pekarek | 15/245 |
| 4,567,621 | 2/1986 | Alley, Jr. | 15/250.41 |
| 5,074,027 | 12/1991 | Alviar et al. | 15/245 |
| 5,321,868 | 6/1994 | Coulson et al. | 15/245 |

FOREIGN PATENT DOCUMENTS

| | | | |
|---|---|---|---|
| 1191306 | 8/1985 | Canada | 15/245 |
| 333028 | 8/1930 | United Kingdom | 15/245 |
| 504083 | 4/1939 | United Kingdom | 15/245 |
| 919745 | 2/1963 | United Kingdom | 15/245 |

*Primary Examiner*—Gary K. Graham
*Attorney, Agent, or Firm*—Dennis W. Beech

[57] ABSTRACT

The adjustable squeegee is a two blade squeegee with a handle. The two blades are mounted in a slot in the handle which allows the two blades to slide longitudinally relative to each other. This allows extending the overall length of the blade tip used to squeegee a surface. The blades may also be removed and mounted in a reverse position to provide space between the two blade tips. Tabs may be used to slide the blades in the handle. In an optional configuration the squeegee handle may have a vertical handle element with slots in the handle for storage and an ice scraper or a hook with an accompanying slot in the handle for storage.

11 Claims, 3 Drawing Sheets

ADJUSTABLE LENGTH SQUEEGEE

CROSS REFERENCES TO RELATED APPLICATION

This is a continuation-in-part of application Ser. No. 08/386,449 filed Feb. 10, 1995 now abandoned.

Application Ser. No. 08/386,449 is pending with claims 1–8 rejected.

BACKGROUND OF THE INVENTION

1. Field of the Invention

This invention relates to devices used to spread, push or wipe liquid material on, across or off a surface. The new device, commonly known as a squeegee, provides a simple means to adjust the length of the wiper blade element to adapt for the size of the surface to be wiped.

2. Description of Related Art

There are currently in use squeegee products of many sizes and shapes. Very large ones are used for window cleaning on commercial buildings and for spreading materials in construction applications. There are smaller wiper blade squeegees used in conjunction with sponges to clean automobile windows. When dealing with ice on windows a scraper blade may be associated with the squeegee. Squeegees are commonly used to clean household windows and hand held versions are available for mirrors and other interior surfaces.

The squeegee in varied forms from the single wiper blade is also used in place of paint brushes to spread paint. Squeegees which have two wiper blade elements, with the blade tips spaced apart, have also been developed.

Currently available squeegees have handles of varying form to which the wiper blade is attached. These may be long poles to reach high places or short handles. The wiper blade may also be contained in a holder and handle without an associated perpendicular handle element.

The present invention provides a two element wiper blade slidably mounted in a handle to allow adjustment of the wiper blade length. The blades may also be reversibly mounted to provide a spaced two blade squeegee. Optional handles may include provision for a storable ice scraper, a hook for storage and a perpendicular handle element.

SUMMARY OF THE INVENTION

A primary objective of the present invention is to provide an adjustable length squeegee blade surface. Another object is to provide a spaced two blade squeegee wiper. A further object is to provide a storable perpendicular handle element for the squeegee. Another object is to provide a storable ice scraper. An additional object is to provide a storable hook for hanging.

In accordance with the description presented herein, other objectives of this invention will become apparent when the description and drawings are reviewed.

DESCRIPTION OF THE PREFERRED EMBODIMENT

The adjustable squeegee consists of a handle having two elongated wiper blades slidably mounted adjacent to each other such that the blades may be adjusted longitudinally relative to each other. The blades may be mounted such that the wiper tips touch or reversed such that there is void space between the wiper tips. The squeegee handle may have a perpendicular handle element which includes provision for holding and storage. An ice scraper blade or a hook may also be mounted to the handle.

Figure 1:
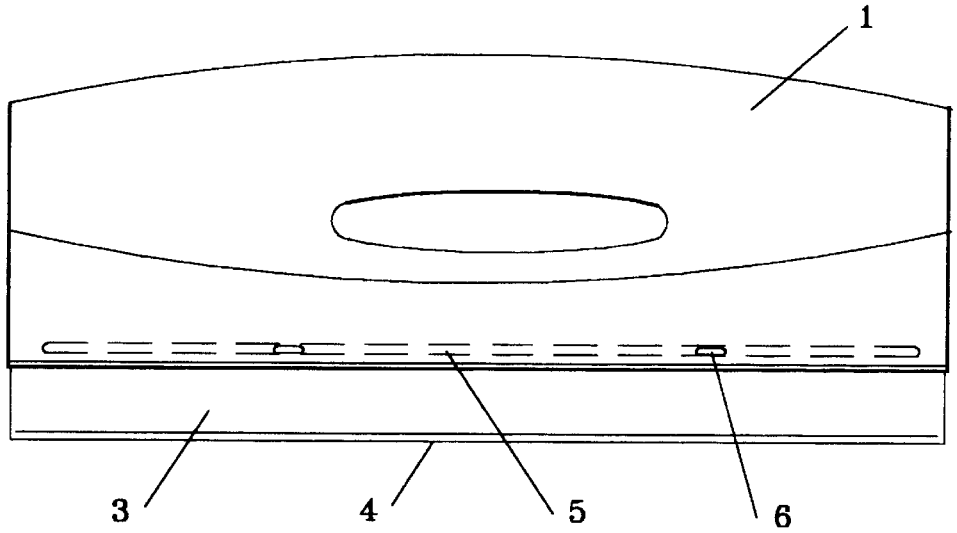
FIG. 1 illustrates a side view of the squeegee.
Figure 2:
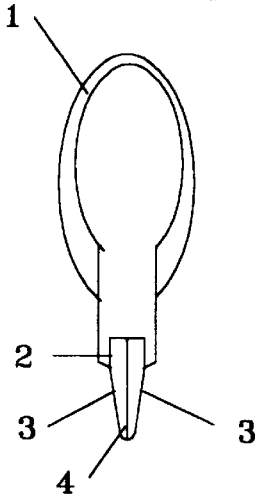
FIG. 2 illustrates an end view of the squeegee.
Figure 3:
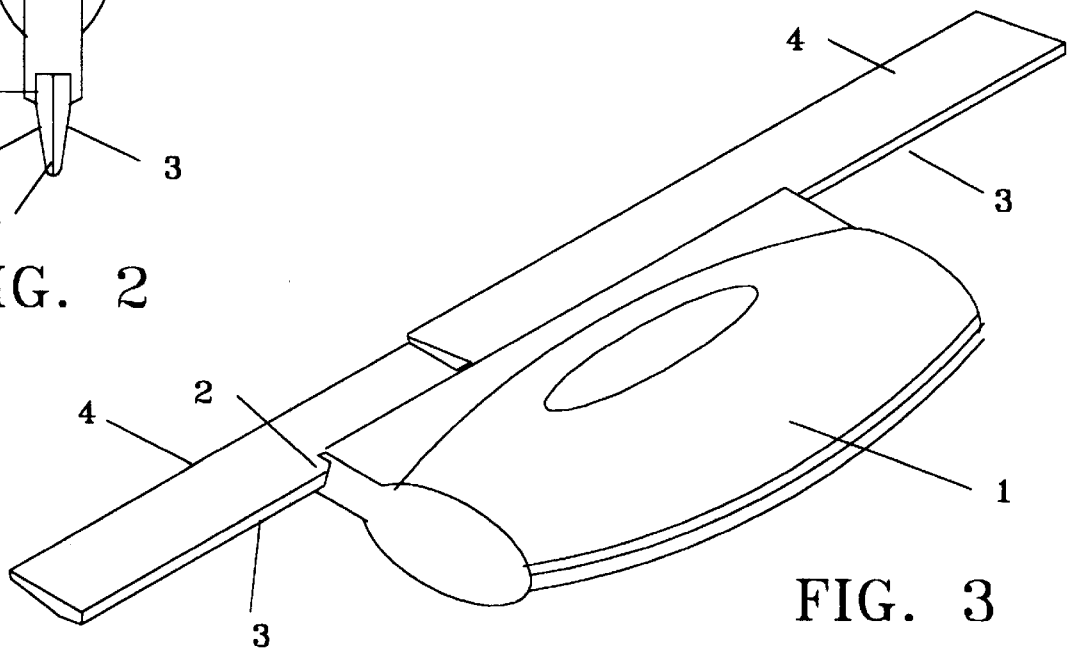
FIG. 3 illustrates a perspective view of the squeegee with the wiper blades extended.

Referring to FIGS. 1 through 3, a handle (1) has a generally oblong shape with a thickness or width to provide a grip for a persons hand. The handle (1) contains a slot (2) in which two elongated blades (3) are slidably mounted adjacent to each other. In FIG. 2 the blades (3) are mounted with the blade tips (4) touching. This presents a single wiping or spreading blade to the surface on which the adjustable squeegee is applied.

Figure 7:
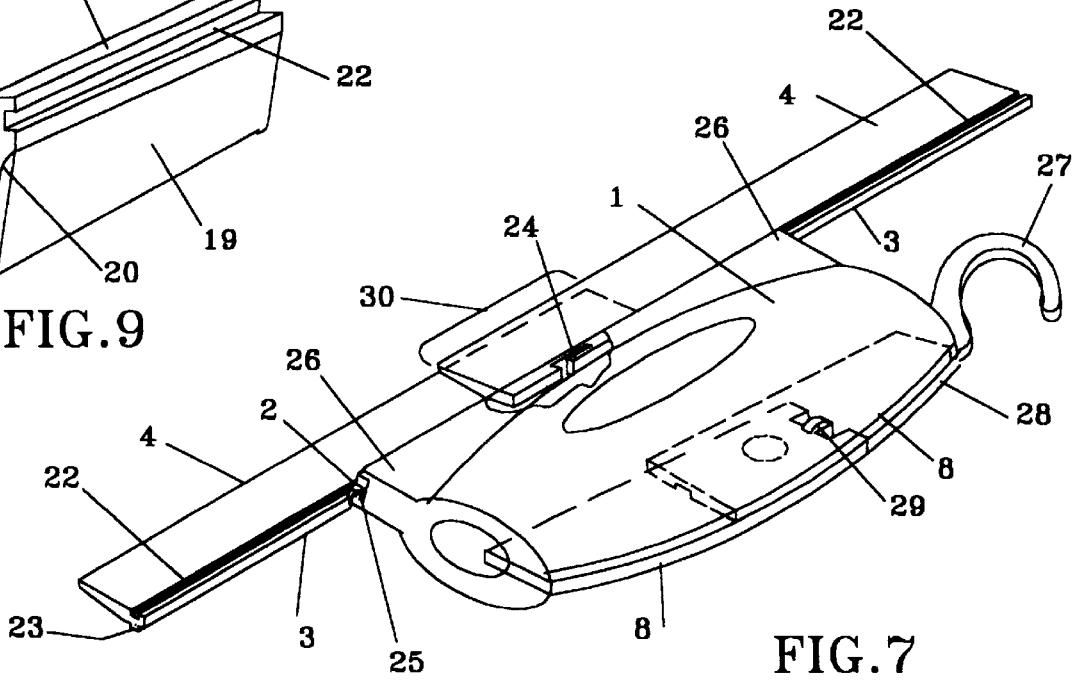
FIG. 7 illustrates a perspective view of the squeegee with the perpendicular handle substantial contained in the handle and the hook extended.

When the blades (3) are moved longitudinally relative to each other as illustrated in FIG. 3, the effective overall blade length is extended. This adjustment allows for application of the adjustable squeegee to surfaces of varying width, such as, panes of glass in French windows and doors to larger panes of glass in more modern windows. The blades (3) have an overlap relative to each other when extended as shown at point (30) as shown in FIG. 7.

Figure 10:
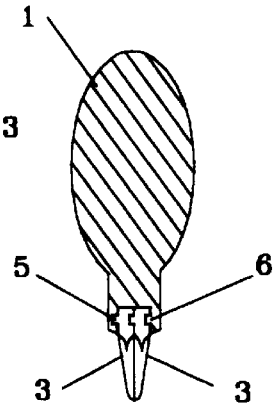
FIG. 10 illustrates a cross sectional view illustrating the grooves and the protrusions interlocked.

The slot (2) may have grooves (5) to receive protrusions (6). This configuration retains the blades (3) in the handle (1) and provides a limit on the distance the blades (3) may be extended. Such a retainer prevents inadvertent pulling of the blades (3) from the handle (1). The slot (2) and the blades (3) may also have alternating grooves (5) and protrusions (6) for interlocking the blades (3) and slot (2) as illustrated in FIG. 10.

Referring to FIG. 7 through 10, the blades (3) may also be of two piece molded construction wherein there is a blade rail (18) of rigid plastic or other suitable material on which is molded a blade edge (19) of flexible plastic, rubber or other suitable material. The molding construction may be made more secure by use of a blade support (20) as part of the blade rail (18). Also the blade support (20) may have attachment holes (21). The attachment holes (21) may be formed in the blade rail (18) during the molding process or by other means such as drilling, punching, etc.

Figure 8:
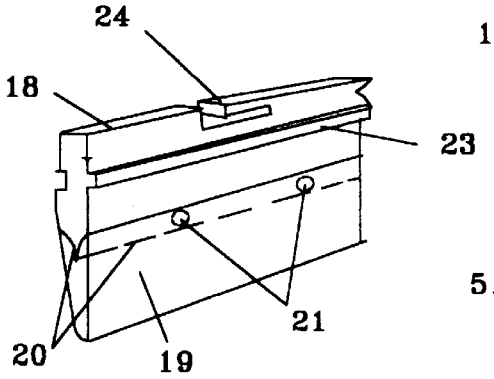
FIG. 8 illustrates a perspective view of the blade with rail and wiping edge.
Figure 9:
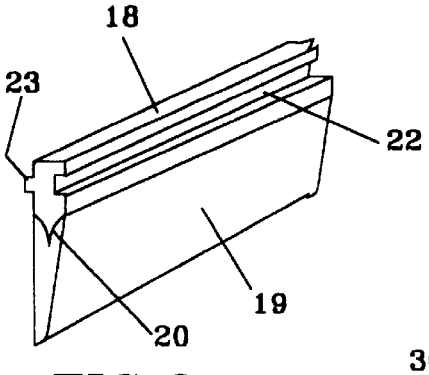
FIG. 9 illustrates a perspective view of an alternate blade with blade rail and wiping edge.

The blade rail (18) and slot (2) as illustrated have alternating rail grooves (22) and rail protrusions (23) for mounting and retaining the blades (3) in the slot (2). A further variation includes a rail stop (24) and groove stop (25) on opposite ends (26) of the slot (2) to prevent sliding a blade (3) out of an end (26). FIGS. 8 and 9 reflect a different molding slant of the blade edge (19) relative to the longitudinal plane of the blade rail (18). The size of the blade edge (19) may he varied depending on the intended application. With the support of the blade rail (18) the blade edge (19) may be made with varying degrees of flexibility and size as FIGS. 8 and 9 only illustrate one of many relative size configurations.

Figure 6:
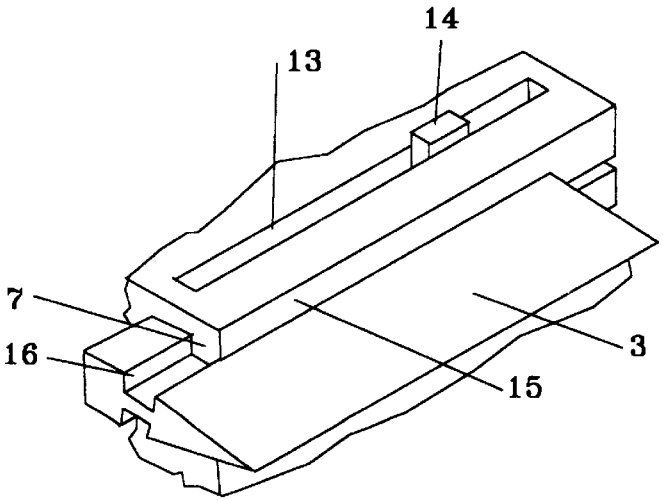
FIG. 6 illustrates a perspective view of an alternate squeegee having blade tab for blade adjustment.

An alternate method as illustrated in FIG. 6, includes a rail (7) formed on the slot tip (15) as illustrated in FIG. 6, which retains the blades (3) in the slot (2) by means of rail slots (16). Provision for protrusions to prevent inadvertent pulling of the blades (3) out of the handle (1) may also be provided in this configuration.

Figure 4:
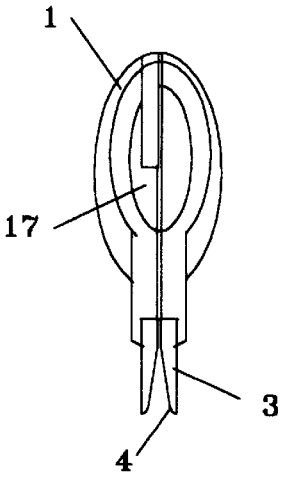
FIG. 4 illustrates an end view with the wiper blades alternatively mounted to provide separated blades.
Figure 11:
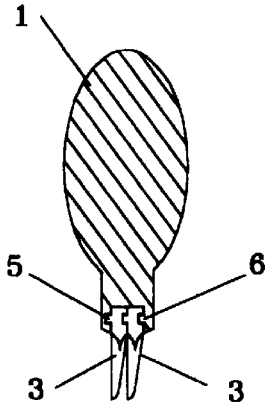
FIG. 11 illustrates a cross sectional view illustrating the grooves and the protrusions interlocked with the blade wiping edge spaced apart.

Both blades (3) may be removed and mounted in reverse position as illustrated in FIG. 4. In this configuration the two blade tips (4) have spacial separation to allow double squeegee action on the surface to which applied. The protrusions (6) and grooves (5) of the handle (1) and blades (3) are design to cooperatively interlock when the blades (3) are reversed in this manner. The blades (3) may also be formed such that when they are interlocked the blades (3) have the same slant on the blade edge (19) relative to the longitudinal plane of the blade rail (18) as illustrated in FIG. 11. In this configuration there is a reduced spacial separation compared to that illustrated in FIG. 4. With proper blade edge (19) flexibility, when the squeegee is applied against a surface the blade edges (19) are pushed together in the area of overlap at point (30).

Figure 5:
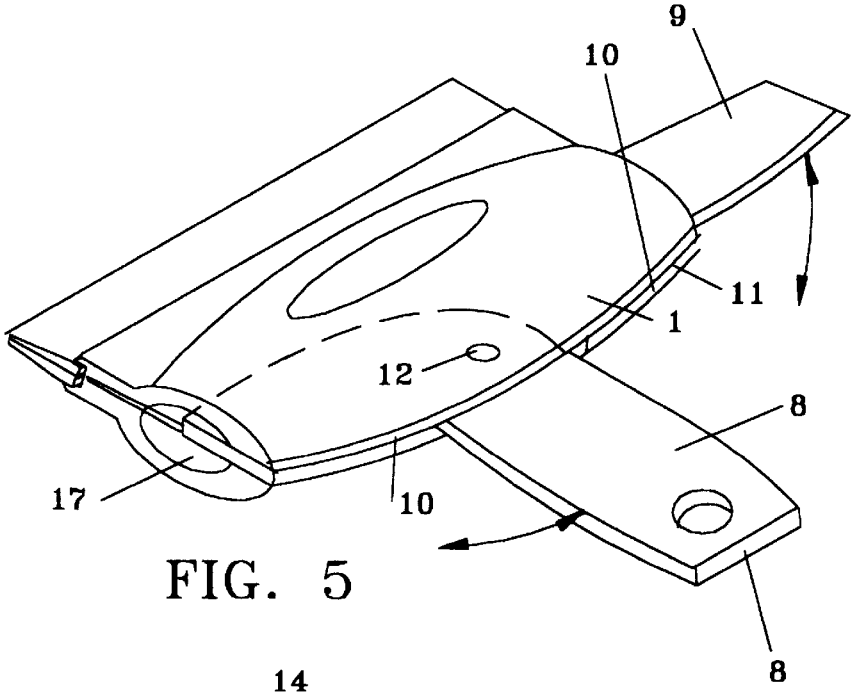
FIG. 5 illustrates a perspective view of the squeegee with the perpendicular handle extended and the ice scraper extended.

Referring to FIGS. 4, 5 and 7, the handle (1) has provisions for a vertical handle (8) element, an ice scraper (9) or a hook (27). There are vertical handle slots (10), an ice scraper slot (11) or a hook slot (28) contained in the handle opposite the slot (2). Finger apertures (17) may be provided for ease of use. The vertical handle (8) is mounted on a pivot point (12) and is formed of two pieces which may be stored in the vertical handle slots (10) or rotated to the vertical position for use in application of the squeegee. The vertical handle (8) may have a locking tab (29).

The ice scraper (9) when extended may be used to scrape ice or other material from a surface. When not in use the ice scraper (9) is rotated into the ice scraper slot (11) for storage. Similarly the hook (27) may be used to hang the device.

Referring to FIG. 6, an alternate version of the adjustable squeegee has a tab slot (13) for movement of a tab (14) connected to the blades (3). In this configuration the blades (3) are moved to lengthen the total wiper blade surface by means of the tabs (14).

I claim:

1. A squeegee device having elongated blades comprising:

a handle having an elongated slot defined therein;

two elongated blades slidably mounted in the slot wherein the blades may be adjusted longitudinally relative to each other;

each blade having a blade wiping edge and a blade rail wherein the blade wiping edge is of flexible material and is molded to the blade rail which is of rigid material;

each blade rail having along the length thereof a rail groove defined therein;

each blade rail having the along length thereof a rail protrusion opposite the rail groove; and the slot having along the length thereof a slot groove defined therein and a slot rail opposite the slot groove.

2. The squeegee device as in claim 1 wherein the blade rail having a stop tab.

3. The squeegee device as in claim 1 wherein the blade rail has an attachment hole in a blade support.

4. The squeegee device as in claim 1 wherein the handle has a vertical handle slot defined therein: a vertical handle substantially contained in the vertical handle slot; and the vertical handle slot having a pivot point to which the vertical handle is rotatably mounted to be rotated out of the vertical handle slot for use.

5. The squeegee device as in claim 1 wherein the handle has a hook slot defined therein; a hook substantially contained in the hook slot; and the hook slot having a pivot point to which the hook is rotatably mounted to rotate out of the hook slot for use.

6. The squeegee device as in claim 1 wherein each blade having a tip wherein the tips having a void space there between along the overlapping portions of the two blades.

7. The squeegee device as in claim 6 wherein the tips touch along the overlapping portions of the two blades when the blades are pressed against a surface.

8. A squeegee device having elongated blades comprising:

a handle having a slot defined therein;

two blades slidably mounted in the slot wherein the blade may be adjusted longitudinally relative to each other; and each blade having a tip wherein the tips touch along overlapping portions of the two blades;

each blade having a blade wiping edge and a blade rail of rigid material wherein the blade wiping edge is attached to the blade rail of rigid material;

each blade rail having along the length thereof a rail groove defined therein;

each blade rail having along the length thereof a rail protrusion opposite the rail groove; and the slot having along the length thereof a slot groove defined therein and a slot rail opposite the slot groove.

9. The squeegee device as in claim 8 wherein the blade rail having a stop tab.

10. The squeegee device as in claim 8 wherein the blade rail has an attachment hole in a blade support.

11. The squeegee device as in claim 8 wherein the handle has a vertical handle slot defined therein; a vertical handle substantially contained in the vertical handle slot; and the vertical handle slot having a pivot point to which the vertical handle is rotatably mounted to be rotated out of the vertical handle slot for use.

* * * * *